US009735516B2

(12) United States Patent
Ens et al.

(10) Patent No.: US 9,735,516 B2
(45) Date of Patent: Aug. 15, 2017

(54) CAR CHARGING CONNECTOR

(71) Applicant: Harting Automotive GmbH, Espelkamp (DE)

(72) Inventors: Valentin Ens, Espelkamp (DE); Marco Grinblats, Bielefeld (DE); Wolfgang Neuhaus, Bad Oeynhausen (DE); Daniel Boesch, Kirchlengern (DE)

(73) Assignee: HARTING AUTOMOTIVE GMBH, Espelkamp (DE)

( * ) Notice: Subject to any disclaimer, the term of this patent is extended or adjusted under 35 U.S.C. 154(b) by 0 days.

(21) Appl. No.: 14/649,706

(22) PCT Filed: Nov. 26, 2013

(86) PCT No.: PCT/DE2013/100398
§ 371 (c)(1),
(2) Date: Jun. 4, 2015

(87) PCT Pub. No.: WO2014/094728
PCT Pub. Date: Jun. 26, 2014

(65) Prior Publication Data

US 2015/0318644 A1 Nov. 5, 2015

(30) Foreign Application Priority Data

Dec. 17, 2012 (DE) ..... 10 2012 024 588

(51) Int. Cl.
*H01R 29/00* (2006.01)
*H01R 13/703* (2006.01)
(Continued)

(52) U.S. Cl.
CPC ..... *H01R 13/703* (2013.01); *H01R 13/424* (2013.01); *H01R 13/502* (2013.01);
(Continued)

(58) Field of Classification Search
CPC .... H01R 13/641; H01R 13/70; H01R 13/703; H01R 13/7039; H01R 13/713; H01R 13/5202; H01R 13/5205; H01R 24/46
(Continued)

(56) References Cited

U.S. PATENT DOCUMENTS 3,843,853 A * 10/1974 Panek ..... H01R 13/635 200/321
4,241,967 A * 12/1980 Collins ..... H01R 13/5205 439/589
(Continued)

FOREIGN PATENT DOCUMENTS

DE 4211486 4/1993
DE 4223712 1/1994
(Continued)

*Primary Examiner* — Hien Vu
(74) *Attorney, Agent, or Firm* — Jacobson Holman, PLLC.

(57) ABSTRACT

The invention relates to a plug-in connector (10) that has an insulation insert (1) and at least one contact element (2), wherein the at least one contact element (2) is connected to a conductor of a cable, wherein the insulation insert (1) has at least one receptacle, in which the at least one contact element (2) and the at least one section of the conductor connected thereto are provided, wherein a first seal (7) that seals the insulation insert (1) is provided in the at least one receptacle, wherein the at least one contact element (2) is sealed in the insulation insert (1) using the first seal (7) and wherein the conductor connected to the at least one contact element (2) is sealed in the insulation insert (1) using a second seal (8). According to the invention, the at least one contact element is held in a receptacle that is substantially formed from an opening (3) and two legs (4) axially protruding therefrom.

9 Claims, 3 Drawing Sheets

Figure 1:
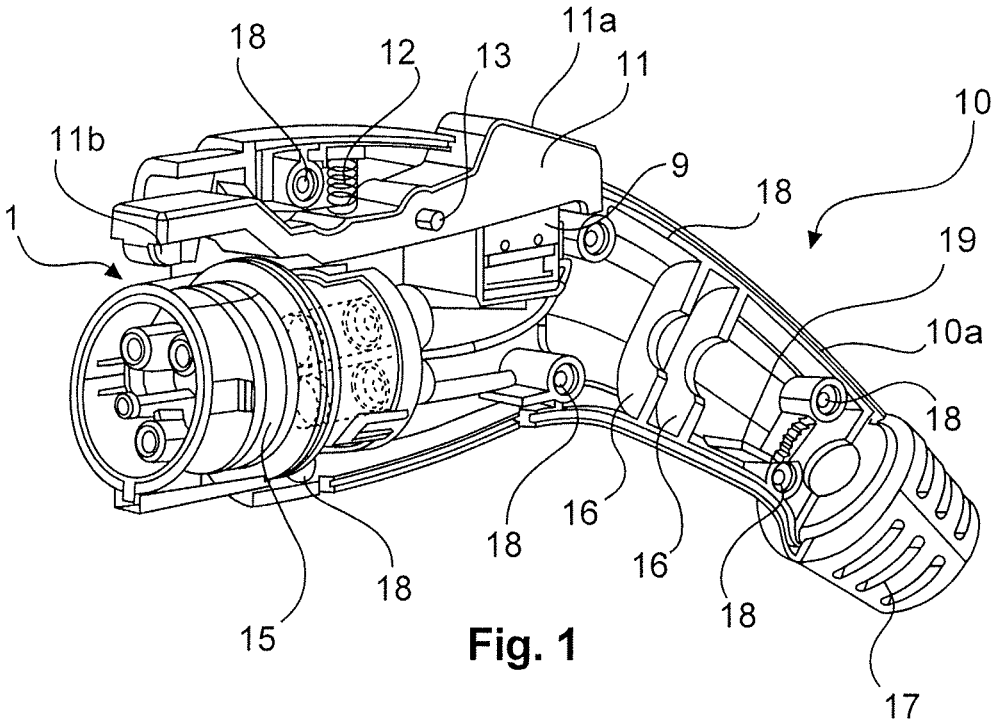

(51) Int. Cl.
*H01R 13/502* (2006.01)
*H01R 13/424* (2006.01)
*H01R 13/52* (2006.01)

(52) U.S. Cl.
CPC ..... *H01R 13/521* (2013.01); *H01R 13/5202* (2013.01); *H01R 2201/26* (2013.01)

(58) Field of Classification Search
USPC ..... 439/188, 851, 682, 595, 587; 200/51.09
See application file for complete search history.

(56) References Cited

U.S. PATENT DOCUMENTS 4,684,187 A 8/1987 Rudy, Jr. et al.
4,973,268 A * 11/1990 Smith ..... H01R 13/443 439/589
5,273,443 A 12/1993 Frantz et al.
5,458,496 A * 10/1995 Itou ..... B60L 11/1846 439/34
5,820,395 A 10/1998 Hashizawa
6,364,692 B1 * 4/2002 Okayasu ..... H01R 13/5219 439/204
7,351,102 B2 * 4/2008 Cykon ..... H01R 13/4368 439/587
7,530,843 B1 5/2009 Tesfay et al.
2012/0295460 A1 11/2012 Ichio et al.

FOREIGN PATENT DOCUMENTS

DE 4413966 10/1994
DE 19650099 6/1997
DE 10114499 11/2003
DE 102006025134 12/2007
EP 0147956 7/1985
EP 0187819 7/1986
EP 2362495 8/2011
GB 2269944 2/1994
WO WO 2012/120834 9/2012
WO WO 2012/161297 11/2012
WO WO 2012/169144 12/2012

* cited by examiner

CAR CHARGING CONNECTOR

The invention relates to a plug-in connector preferably used for transmitting high currents.

PRIOR ART

A plug-in connector of this type has to be sealed against the ingress of media such as for example dust and water.

EP 2362495 B1 shows a car charging connector that is sealed in the plugged-in condition by means of a bellows-type seal.

However, it has been shown that this type of seal for a plug-in connector is not sufficient. Over time, moisture can get into the inside of the plug-in connector.

During daily use, this seal is exposed to severe ageing influences. Therefore, the durability of such a charging connector is not high.

U.S. Pat. No. 7 530,843 B1, US 2012 0295 460 A1, WO 2012 169 144 A1 and DE 196 50 099 A1 all show car charging connectors. The contact elements are here completely surrounded by the contact support within the plug-in connector housing which, under certain circumstances, leads to high plug-in forces.

OBJECT OF THE INVENTION

It is the object of the invention to propose a plug-in connector that is easy to manufacture, has a long life cycle and is easy to handle.

Advantageous embodiments of the invention are set out in the dependent claims.

The plug-in connector proposed here comprises an insulation insert that is embedded in the housing of the plug-in connector.

In a receptacle of the insulation insert, at least one contact element and at least one section of a conductor of a multi-core cable that is connected thereto are embedded. The electrical contacting of the conductor may be realised for example by means of a crimp connection.

As a rule, an insulation insert comprises a plurality of contact elements. Accordingly, also a plurality of the receptacles mentioned above is provided, in each of which the contact elements and sections of conductors of a multi-core cable connected thereto are embedded.

The at least one contact element protrudes from the insulation insert on an end side thereof. The direction in which the contact elements protruding from the insulation insert face is also referred to as the plug-in direction. The end side of the insulation insert, from which the at least one contact element protrudes, is accordingly referred to as the plug-in side, The term "protrude" is here not to be understood to mean that the contact element protrudes beyond the end face of the insulation insert. As a rule, a collar is provided on the insulation insert, which protrudes beyond the contact element. The term "protrude" is here to be understood to mean that the contact element faces in the direction of the end face and is orientated substantially orthogonally to the end face.

The area from which the at least one contact element protrudes is sealed using a first seal. Or in other words, on the plug-in side, the at least one contact element is sealed using a first seal against media such as dust and water.

The end side of the insulation insert that is opposite the plug-in side is also referred to as the connection side. The conductor that is electrically connected to the contact element protrudes from the connection side of the insulation insert. Within the insulation insert, therefore, a section of the connected conductor is located.

The area from which the section protrudes from the insulation body is sealed using a second seal. Or in other words, the conductor protruding from the insulation insert on the connection side is sealed via a second seal against media such as for example dust and water.

It goes without saying that in the case of a plurality of contact elements located in the insulation insert, also a plurality of first and second seals must be present which seal the insulation insert, i.e. the respective contact element on the plug-in side and the conductor connected thereto on the connection side.

Such a double seal in the insulation insert is particularly reliable. Moreover, it can be realised at low costs.

Advantageously, the insulation insert is formed at least in two parts. The individual parts are, in the assembled condition, sealed using a third seal against media such as for example dust and water. As a result of the fact that the insulation insert consists of multiple parts, the production process for the plug-in connector is simplified. In this way, contact elements can, from a manufacturing point of view, be easily introduced.

It is particularly advantageous if at least one further contact element is provided in the insulation insert, which is connected to a circuit breaker via a conductor. The circuit breaker can be used to switch the plugged-in plug-in connector off. The circuit breaker is positioned outside of the insulation insert, but inside of the plug-in connector housing. From the circuit breaker, which is also referred to as a microswitch, a conductor leads into the inside of the insulation insert. This conductor is sealed using a seal. The circuit breaker is at least partially cast in a non-conductive material, as a result of which it is sealed against media.

Advantageously, the circuit breaker is connected to a control circuit. The function of the control circuit will be explained in more detail below.

Advantageously, the housing of the plug-in connector comprises an actuation means that is accessible from the outside. The actuation means may for example be a push button or a slide button.

It is particularly advantageous if the circuit breaker can be activated via the actuation means and the plug-in connector can be switched on or off. To this end, the control circuit already mentioned above is used.

Once the circuit breaker has been actuated, the plug-in connector can be pulled out of a so-called charging socket. In order to ensure that the plug-in connector can be pulled out during a current flow (not under load), any charging progress is interrupted in order to protect the operator and/or the charging station during the actuation of the locking lever. Technically, this is achieved as a result of the change in resistance of the microswitch (unswitched: 150 ohms-switched: 480 ohms).

Additionally, or as an alternative, the actuation means comprises locking means via which the plug-in connector can be locked to a socket and/or a counter connector. For example, this is a blocking lever that prevents the plug-in connector from being inadvertently pulled out of a socket.

The invention proposed here is applied for example in car charging connectors because particularly reliable and secure plug-in connectors having a long life cycle are required here.

A particularly preferred embodiment example of the plug-in connector is implemented in such a way that the insulation insert of the plug-in connector has at least one receptacle for a contact element that is substantially formed from an opening and two legs axially protruding therefrom.

Particularly preferably, the insulation insert is formed in two parts, with each part having an opening. In the assembled condition, the openings of the insulation insert parts are in alignment with each other, The openings may also be referred to as bores or feedthroughs. The term "alignment" means here that main axes of symmetry of the openings (bores, feedthroughs) are in alignment with each other. In the case of a two-part insulation insert, the receptacles then consist of the openings described above, which are aligned to each other, and the axially protruding legs as already mentioned above.

EMBODIMENT EXAMPLE

Figure 2:
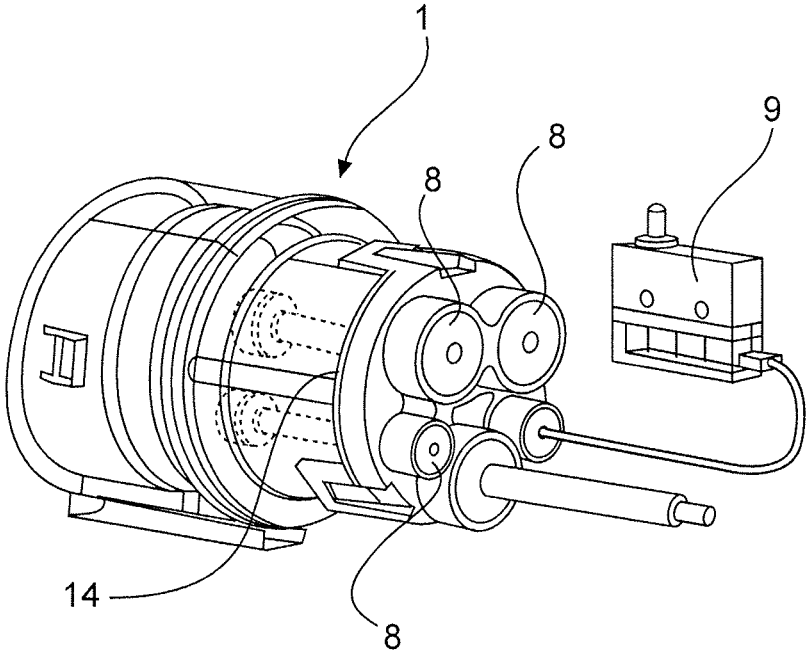
Figure 3:
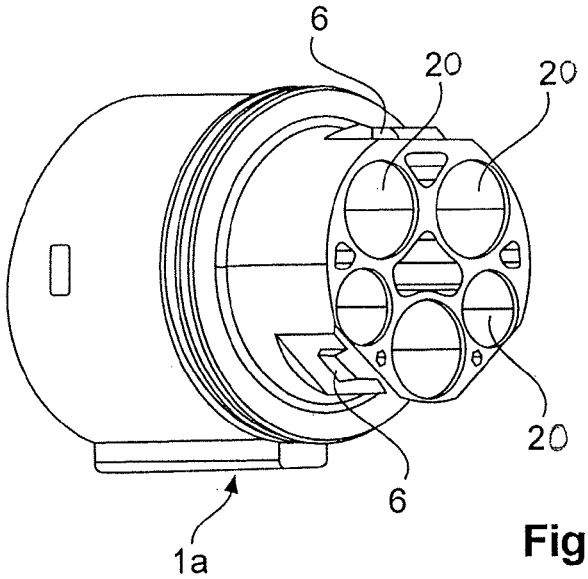
Figure 4:
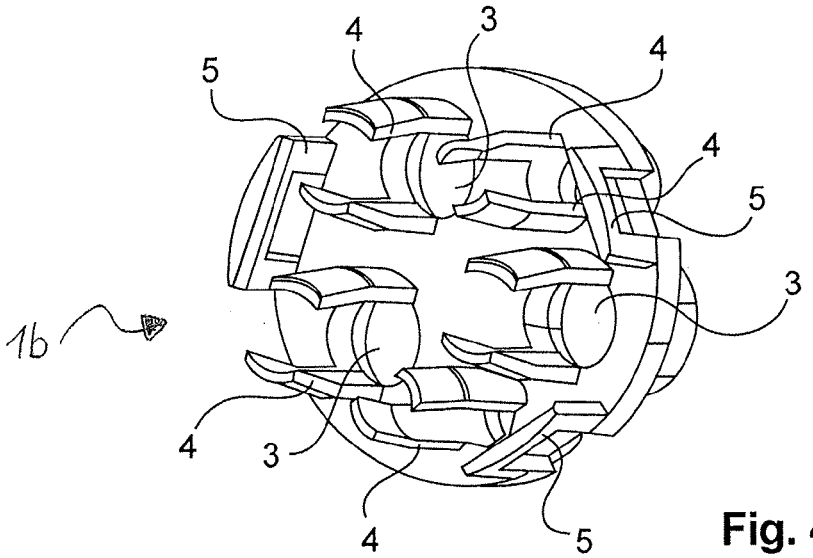
Figure 5:
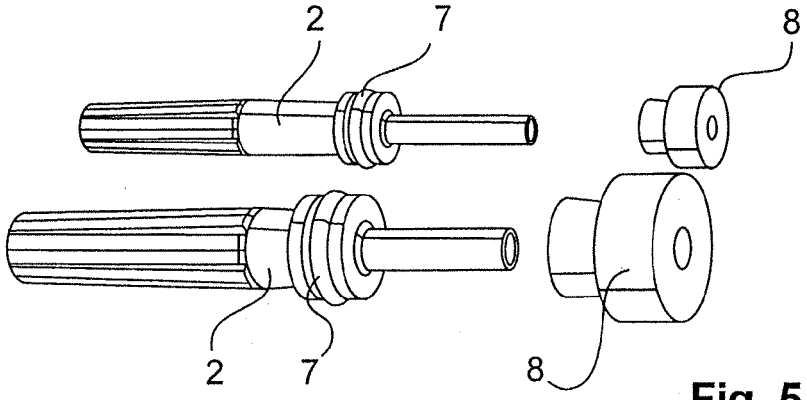
Figure 6:
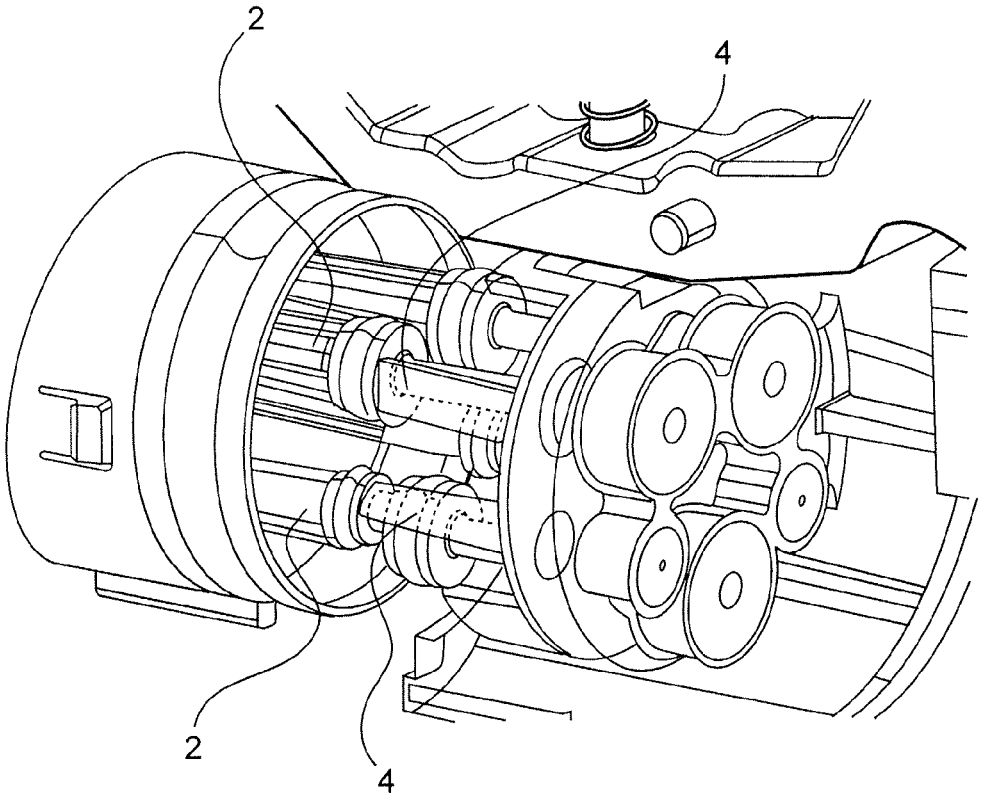

An embodiment example of the invention is shown in the drawings and will be explained in more detail below, wherein:

FIG. 1 shows a perspective view of a plug-in connector with an opened half-shell, FIG. 2 shows a perspective view of an insulation insert, FIG. 3 shows a perspective view of a first part of the insulation insert, FIG. 4 shows a perspective view of a second part of the insulation insert, FIG. 5 shows a perspective view of the contact elements located in the insulation insert with associated seals, and FIG. 6 shows a perspective view of the contact elements in the second part of the insulation insert.

FIG. 1 shows a perspective view of a plug-in connector 10 according to the invention, comprising an insulation insert 1 that is inserted, for illustration purposes, into a half-shell 10*a* of the plug-in connector 10. The plug-in connector housing is closed with a second half-shell (not shown) that matches the half-shell 10*a*. The insulation insert 1 is sealed in the plug-in connector housing using a (fourth) seal 15, a so-called moulded seal. The fourth seal 15 has the function of sealing the contact area in the plugged-in condition.

The half-shell 10*a* of the plug-in connector housing has support shells 16. The second half-shell also comprises such support shells which are in alignment with the support shells 16 of the first half-shell 10*a*. The cable sheath of the connected multi-core cable is inserted and fixed between the support shells. On one end of the plug-in connector housing, a kink protection element 17 is provided which protects the connected cable from damage. Moreover, it protects the plug-in connector housing against the ingress of dust.

The plug-in connector housing comprises a strain relief element 19 that is provided on the inside of the housing.

The half-shell 10*a* is provided with threaded bores 18. The half-shells may be connected to each other via a screw connection and in this way form the plug-in connector housing. Via this screw connection, the plug-in connector housing can also be opened again so that service and repair work can be carried out because the plug-in connector housing does not comprise a closed outer sheathing, for example a rubber coating.

The first part 1*a* of the insulation insert 1 is formed to be substantially cylindrical and the body has two different radii and can therefore also be identified as a double cylinder body. Openings 20 are provided in the insulation insert 1, into which contact elements 2 can be inserted.

A second part 1*b* of the insulation insert 1 is substantially formed as a flat disc, in which openings 3 are provided which are in alignment with the openings 20 in the first part 1*a*, as soon as the two parts 1*a*, 1*b* are assembled. Two legs 4 axially protrude from each of the openings 3. The legs 4 are slightly bent towards each other in their end regions, i.e. radially inwards. The legs 4 laterally engage on the contact elements 2 and are used to keep the contact elements 2 in their position in the insulation insert 1. The contact elements 2 are fixed, but they have enough play an that the plug-in connector can be easily inserted. If one were to fix the contact elements differently, with less play, then high plug-in forces and a low functionality might result under certain circumstances, The function of the legs 4 can be seen in FIG. 6.

In order to allow the parts 1*a*, 1*b* of the insulation insert 1 to be connected to each other in a captive manner, the second part 1*b* comprises axially protruding latching legs 5 which can in each case engage in latching noses 6 of the first part 1*a*, which are provided for this purpose. The individual parts 1*a*, 1*b* of the insulation insert 1 are sealed via a third seal 14, a so-called flat seal.

The contact elements 2 protrude from an end side of the insulation insert 1. This end side is also referred to as the plug-in side. From the opposite end side of the insulation insert 1, the conductors (not shown) of a multi-core cable protrude, which are connected to the contact elements 2. The contact elements 2 are sealed in the insulation insert 1 via a first seal 7 and the conductors connected thereto via a second seal 8.

The first seal is a so-called O-ring that is inserted in an annular recess of the contact element 2. The second seal is a cable seal.

The seals 7, 8, 14, 15 as mentioned above may be made from an EPDM or an NBR elastomer. Particularly preferably however, the materials perfluorinated rubber (FFKM or FFPM), polyethylene (PE) or polytetrafluorethylene (PTFE) are used individually or in combination. As a result, particularly durable sealing properties are achieved.

At least one contact element 2 is connected to a circuit breaker 9 in the insulation insert 1. The conductor between the contact element 2 and the circuit breaker 9 is sealed via a second seal 8.

The circuit breaker can be used to switch the plugged-in plug-in connector off. The circuit breaker 9 is positioned outside of the insulation insert, but within the plug-in connector housing 10*a*.

In order to seal the circuit breaker 9, the latter is at least partially cast in a non-conductive material. Preferably, the potting compound is an epoxy resin or a rubber compound or glass or a combination of the above-mentioned materials.

The circuit breaker 9 is connected to a control circuit, via which the plug-in connector can be switched off.

The housing of the plug-in connector 10 comprises an actuating means 11 that is accessible from the outside. The actuation means 11 is supported in the plug-in connector housing on a tilt axis 13 and is operatively connected to a spring 12 that drives, upon actuation, the push button 11*a* of the actuating means 11, which is visible from the outside, back out.

When the push button 11*a* is actuated, the circuit breaker 9 is activated and the plug-in connector 10 is switched off. No current can flow, Current flow is not released until the actuation force is removed from the push button 11*a*. This is advantageous for safety reasons.

Moreover, the actuation means 11 is provided with locking means formed as a latching hook 11*b*. The latching hook 11*b* engages, in the plugged-in condition, for example in an undercut of a counter connector and/or of a socket (not shown) and latches the two together. The latching between the plug-in connector and the counter connector or the plug-in connector and the socket does not become effective until no force acts on the actuation button 11*a* any longer.

This means that the current flow is not released again until the latching is complete. This, too, is an important safety feature of the plug-in connector 10.

LIST OF REFERENCE NUMERALS

Insulation insert 11. Actuating means
1*a* First part 11*a* Push button
1*b* Second part 11*b* Latching hook
2 Contact element 12. Spring
3 Opening 13. Tilt axis
4 Legs 14. Third seal
5 Latching legs 15. Fourth seal
6 Latching nose 16. Support shell
7 First seal 17. Kink protection element
8 Second seal 18. Threaded bore
9 Circuit breaker 19. Stress relief
10 Car charging connector 20. Openings
10*a* Half-shell

The invention claimed is:

1. An electrical plug-in connector comprising, an insulation insert comprising an enclosed wall that extends in a longitudinal direction between one end defining a plug-in side and an opposite end defining a connection side, said insulation insert including at least one receptacle extending in a direction between the plug-in side and connection side, said receptacle having a plug-in side opening and a connection side opening, a flat disc positioned at said connection side opening, said flat disc having two legs located adjacent said connection side opening and extending into the receptacle in a direction toward said plug-in side opening, a contact element positioned within said receptacle and protruding from the plug-in side opening, said contact element engaged and retained by said two legs of said flat disc, a conductor of a cable connected to said contact element wherein a section of said cable conductor is within a portion of said contact element, said cable conductor protruding from the connection side opening, a first seal within said receptacle to seal the contact element with respect to the insulation insert on the plug-in side, and a second seal within said receptacle to seal the cable conductor to the insulation insert on the connection side.

2. The plug-in connector according to claim 1, characterised in that the insulation insert is formed in two parts that are sealed to each other through a third seal.

3. The plug-in connector according to claim 1, characterised in that said plug-in side opening and said connection side opening are in alignment with each other.

4. The plug-in connector as claimed in claim 1, characterised in that the insulation insert has a fourth seal that seals the insulation insert in a plugged-in condition.

5. The plug-in connector according to claim 1, characterised in that the insulation insert has at least two contact elements.

6. The plug-in connector according to claim 1, characterised in that said plug-in connector has a circuit breaker to switch the plug-in connector off, said circuit breaker at least partially disposed within a non-conductive material and sealed thereby and, wherein the insulation insert includes at least a further receptacle with a further contact element therewithin, and a conductor connecting said further contact element to said circuit breaker, said connector extending from a connection side opening, and sealed thereto.

7. The plug-in connector according to claim 6, characterised in that the plug-in connector has an actuator that is accessible from the outside.

8. The plug-in connector according to claim 7, characterised in that said circuit breaker can be activated via the actuator to switch the plug-in connector on or off.

9. The plug-in connector according to claim 1, characterised in that the seals are made from the materials perfluorinated rubber (FFKM or FFPM) or polyethylene (PE) or polytetrafluorethylene (PTFE) or from a combination of these materials.

* * * * *